US009076455B2

(12) United States Patent
Krini et al.

(10) Patent No.: US 9,076,455 B2
(45) **Date of Patent: *Jul. 7, 2015**

(54) TEMPORAL INTERPOLATION OF ADJACENT SPECTRA

(75) Inventors: Mohamed Krini, Ulm (DE); Gerhard Schmidt, Ulm (DE); Bernd Iser, Ulm (DE); Arthur Wolf, Neu-Ulm (DE)

(73) Assignee: NUANCE COMMUNICATIONS, INC., Burlington, MA (US)

( * ) Notice: Subject to any disclaimer, the term of this patent is extended or adjusted under 35 U.S.C. 154(b) by 197 days.

This patent is subject to a terminal disclaimer.

(21) Appl. No.: 13/591,667

(22) Filed: Aug. 22, 2012

(65) Prior Publication Data

US 2013/0208905 A1 Aug. 15, 2013

(30) Foreign Application Priority Data

Aug. 22, 2011 (EP) ..... 11178320

(51) Int. Cl.
*G10L 21/0208* (2013.01)
*G10K 11/00* (2006.01)
(Continued)

(52) U.S. Cl.
CPC ..... *G10L 21/0208* (2013.01); *G10K 11/002* (2013.01); *G10L 21/02* (2013.01); *G10L 2021/02082* (2013.01); *G10L 19/0204* (2013.01)

(58) Field of Classification Search
CPC ..... G10L 19/0204; G10L 21/0208; G10L 2021/02082; G10L 21/02; H04R 2410/05; H04R 1/1083; H04M 9/082; G10K 11/002; H03H 2021/0041
USPC ..... 381/71.8, 71.11, 71.12, 71.14, 66, 94.1, 381/94.2, 94.3, 94.4, 95, 96; 379/3, 406.01, 379/406.02, 406.05, 406.08, 406.09, 379/406.12, 406.13, 406.14; 455/570
See application file for complete search history.

(56) References Cited

U.S. PATENT DOCUMENTS 5,699,404 A 12/1997 Satyamurti et al. ..... 379/57
5,721,772 A * 2/1998 Haneda et al. ..... 379/406.14
(Continued)

FOREIGN PATENT DOCUMENTS

EP 0 767 462 A2 4/1997
EP 1 927 981 A1 6/2008
EP 1 936 939 A1 6/2008

OTHER PUBLICATIONS

Hänsler et al., Acoustic Echo and Noise Control: A Practical Approach, 7 pages, 2004.
(Continued)

*Primary Examiner* — Vivian Chin
*Assistant Examiner* — Jason R Kurr
(74) *Attorney, Agent, or Firm* — Daly, Crowley, Mofford & Durkee, LLP

(57) ABSTRACT

Embodiments of the present invention exploit redundancy of succeeding FFT spectra and use this redundancy for computing interpolated temporal supporting points. An analysis filter bank converts overlapped sequences of an audio (ex. loudspeaker) signal from a time domain to a frequency domain to obtain a time series of short-time loudspeaker spectra. An interpolator temporally interpolates this time series. The interpolation is fed to an echo canceller, which computes an estimated echo spectrum. A microphone analysis filter bank converts overlapped sequences of an audio microphone signal from the time domain to the frequency domain to obtain a time series of short-time microphone spectra. The estimated echo spectrum is subtracted from the microphone spectrum. Further signal enhancement (filtration) may be applied. A synthesis filter bank converts the filtered microphone spectra to the time domain to generate an echo compensated audio microphone signal. Computational complexity of signal processing systems can, therefore, be reduced.

17 Claims, 6 Drawing Sheets

(51) Int. Cl.
*G10L 21/02* (2013.01)
*G10L 19/02* (2013.01)

(56) References Cited

U.S. PATENT DOCUMENTS

| | | | | |
|---|---|---|---|---|
| 5,774,561 | A * | 6/1998 | Nakagawa et al. | 381/66 |
| 6,856,653 | B1 * | 2/2005 | Taniguchi et al. | 375/285 |
| 6,970,511 | B1 | 11/2005 | Barnette | 375/240.21 |
| 7,328,162 | B2 | 2/2008 | Liljeryd et al. | 704/503 |
| 8,194,852 | B2 * | 6/2012 | Buck et al. | 379/406.14 |
| 8,320,575 | B2 * | 11/2012 | Schmidt et al. | 381/66 |
| 2008/0177532 | A1 | 7/2008 | Greiss et al. | 704/200.1 |
| 2008/0253553 | A1 | 10/2008 | Li et al. | 379/406.05 |
| 2009/0144053 | A1 | 6/2009 | Tamura et al. | 704/207 |
| 2011/0044461 | A1 * | 2/2011 | Kuech et al. | 381/66 |

OTHER PUBLICATIONS

Hannon et al., "Reducing the Complexity or the Delay of Adaptive Sub-band Filtering", 8 pages, Sep. 8, 2010.
European Search Report for European Patent Application No. EP 11 17 2380, 4 pages, Jan. 11, 2012.
European Patent Application No. 11178320.5-1910/2562751 Decision to grant a European Patent dated May 15, 2014 3 pages.
Intention to Grant in EP Application No. 11 178 320.5 dated Feb. 4, 2014, 7 pages.

* cited by examiner

TEMPORAL INTERPOLATION OF ADJACENT SPECTRA

CROSS REFERENCE TO RELATED APPLICATIONS

This application claims the benefit of European Patent Application No. EP 11178320.5, filed Aug. 22, 2011, titled "Temporal Interpolation of Adjacent Spectra," the entire contents of which are hereby incorporated by reference herein, for all purposes.

TECHNICAL FIELD

The present invention relates to signal processing, such as for speech enhancement, and, more particularly, to temporal interpolation of spectra in adaptive filtering algorithms for echo cancellation.

BACKGROUND ART

Speech is an acoustic signal produced by human vocal apparatus. Physically, speech is a longitudinal sound pressure wave. A microphone converts the sound pressure wave into an electrical signal. The electrical signal can be sampled and stored in a digital format.

Currently, sample rates used for speech applications are increasing due to the transition from "conventional" transmission systems, such as ISDN or GSM, to so-called "wideband" or even "super-wideband" transmission systems. Furthermore, more and more multi-channel approaches (in terms of more than one loudspeaker and/or more than one microphone) are entering the market (e.g., voice-controlled TV or home stereo systems). As a consequence, hardware requirements of such systems, mainly in terms of computational complexity, will increase tremendously, and a need for efficient implementations arises.

In many applications, the signal waveform of an audio or speech signal is converted into a time series of signal parameter vectors. Each parameter vector represents a sequence of the signal (signal waveform). This sequence is often weighted by means of a window. Consecutive windows generally overlap. The sequences of the signal samples have a predetermined sequence length and a certain amount of overlapping. The overlapping is predetermined by a sub-sampling rate often expressed in a number of samples. The overlapping signal vectors are transformed by means of a discrete Fourier transform (DFT) into modified signal vectors (e.g., complex spectra). The discrete Fourier transform can be replaced by another transform, such as a cosine transform, a polyphase filter bank or any other appropriate transform.

The reverse process of signal analysis, called signal synthesis, generates a signal waveform from a sequence of signal description vectors, where the signal description vectors are transformed to signal subsequences that are used to reconstitute the signal waveform. The extraction of waveform samples is followed by a transformation applied to each vector. A well-known transformation is the discrete Fourier transform (DFT). Its efficient implementation is the fast Fourier transform (FFT). The DFT projects the input vector onto an ordered set of orthogonal basis vectors. The output vector of the DFT corresponds to the ordered set of inner products between the input vector and the ordered set of orthogonal basis vectors. The standard DFT uses orthogonal basis vectors that are derived from a family of complex exponentials.

To reconstruct the input vector from the DFT output vector, one must sum over the projections along the set of orthonormal basis functions.

If the magnitude and phase spectrum are well defined, it is possible to construct a complex spectrum that can be converted to a short-time speech waveform representation by means of inverse Fourier transformation (IFFT). The final speech waveform is then generated by overlapping and adding (OLA) the short-time speech waveforms.

Signal and speech enhancement describes a set of methods or techniques that are used to improve one or more speech related perceptual aspects for a human listener. A very basic system for speech enhancement, in terms of reducing echo and background noise, consists of an adaptive echo cancellation filter and a so-called post filter for noise and residual echo suppression. Both filters operate in the time domain.

A basic structure of such a system is depicted in FIG. 1. A loudspeaker 100 plays a signal 102 of a remote communication partner or signals (prompts) of a speech dialog system (not shown). A microphone 104 records a speech signal of a local speaker 106. Besides the speech components of the local speaker 106, the microphone 104 also picks up echo components originating from the loudspeaker 100 and background noise.

To get rid of the undesired components (echo and noise), adaptive filters are used. An echo cancellation filter 108 is excited with the same signal 102 that drives the loudspeaker 100, and its coefficients are adjusted such that the filter's impulse response models the loudspeaker-room-microphone system 109. If the model fits the real system 109, the filter output 110 is a good estimate of the echo components in the microphone signal 112, and echo reduction can be achieved by subtracting the estimated echo components 110 from the microphone signal 112.

Afterwards, a filter 114 in the signal path of the speech enhancement system can be used to reduce the background noise as well as remaining echo components. The filter adjusts its filter coefficients periodically and needs, therefore, estimated power spectral densities of the background noise and of the residual echo components. Finally, some further signal processing 116 might be applied, such as automatic gain control or a limiter.

The speech enhancement system with all components operating in the time domain has the advantage of introducing only a very little delay, mainly caused by the noise and residual echo suppression filter 114. The drawback of this system is the very high computational load that is caused by pure time domain processing.

The computation complexity can be reduced by a large amount (reductions of 50 to 75 percent are possible, depending on the individual setup) by using frequency domain or sub-band domain processing, as shown in FIG. 2. For such systems, all input signals 200 and 202 are transformed periodically into, e.g., the short-term Fourier domain by means of analysis filter banks 204 and 206, and all output signals are transformed back into the time domain by means of a synthesis filter bank 208. Echo reduction can be achieved by estimating echo portions 210 (filter coefficients) in the frequency domain and by subtracting (removing) the estimated echo 212 from the spectra 214 of the input signal 202 (microphone). Sub-band components of the spectra 212 of the echo signal can be estimated by weighting the (adaptively adjusted) filter coefficients with the sub-band components in the spectra 216 of the loudspeaker signal 200. Typical adaptation algorithms for adaptively adjusted filter coefficients are the least mean square algorithm (NLMS), normalized least mean square algorithm (NLMS), recursive least squares algorithm (RLS) or affine projection algorithms (see E. Hänsler, G. Schmidt: Acoustic Echo and Noise Control, Wiley, 2004, hereinafter referred to as "Hänsler"). Echo reduction is achieved by subtracting the estimated echo sub-band components 212 from the microphone sub-band components 214. Finally the echo reduced spectra are transformed 208 back into the time domain, where overlapping of the calculated time series depends on the overlapping (sub-sampling) applied to the original signal waveform when the spectra were created.

The complexity reduction comes from sub-sampling that is applied within the analysis filter banks. The highest reduction is achieved if the so-called sub-sampling rate is equal to the number of frequency supporting points (sub-bands) that are generated by the filter bank. However, as described by Hänsler, larger sub-sampling rates cause larger so-called aliasing terms that limit performance of echo cancellation filters. In digital signal processing and related disciplines, aliasing refers to an effect that causes different spectral components to become indistinguishable (or aliases of one another) when a corresponding time signal is sampled or sub-sampled.

Due to sub-sampling, an echo cancellation filter is excited with several shifted and weighted versions of a spectrum, where only one of them is the desired one. The undesired spectra hinder the adaptation of the filter. To demonstrate that behavior, two measurements are presented in FIG. 3. The loudspeaker emits white noise for these measurements (signal 300). A Hann-windowed FFT of size 256 was used in both measurements. The microphone output (the output without echo cancellation) was normalized to have a short-term power of about 0 dB. Since no local signals are used during the measurements, the aim of echo cancellation is to reduce the output signal after subtracting the estimated echo component (this signal is called the error signal) as much as possible.

If the sub-sampling rate is chosen to be 64 (a quarter of the FFT size), good echo cancellation performance can be measured (signal 304 of FIG. 3). Finally, about 40 dB of echo reduction can be achieved, which is usually more than sufficient (about 30 dB is typically enough). This setup is able to reduce the computational complexity by a large amount; however, for several applications, even higher reductions are necessary. If the sub-sampling rate would be increased to 128 (half of the FFT size), the computational complexity of the system can be reduced by a factor of 2, compared to the set up with a sub-sampling rate of 64. However, now the performance (signal 302 in FIG. 3) is not sufficient (only about 8 dB echo reduction can be achieved). The reason for that limitation is the increased aliasing terms, as noted by Hänsler.

Up to now, two extensions are known that allow reduction of aliasing terms and thus increasing the sub-sampling rate. The first extension is to use better filter banks, such as polyphase filter banks. Instead of using a simple window, such as a Hann or a Hamming window, a longer so-called low-pass prototype filter can be applied. The order of this filter is a multiple of the FFT size and can achieve arbitrarily small aliasing components (depending on the filter length). As a result, very high sub-sampling rates (they can be chosen close to the FFT order) and thus also a very low computational complexity can be achieved. However, the drawback of this solution is an increase in the delay that the analysis and the synthesis filter banks introduce. This delay is usually much higher than recommended by ITU-T and ETSI. As a result, polyphase filter banks are able to reduce the computational complexity but, because of the increased delay they introduce, they can be applied in only a few selected applications.

The second extension is to perform the FFT of the reference signal more often, compared to all other FFTs and IFFTs. This also helps to reduce the aliasing terms, now without any additional delay. With this method, the performance of the echo cancellation is not as good as with a conventional setup, i.e., with a small sub-sampling rate, but a sufficient echo reduction can be achieved, as disclosed in EP 1936939 A1.

A comparison of the conventional method as well as of the two extensions can be found in P. Hannon, M. Krini, G. Schmidt, A. Wolf: Reducing the Complexity or the Delay of Adaptive Sub-band Filtering, Proc. ESSV 2010, Berlin, Germany, 2010.

EP 1927981 A1 describes a second method which also has some relevance. With a standard short-term frequency analysis, such as a 256-FFT using a Hann window in applications such as hands-free telephone systems, a frequency resolution of about 43 Hz (distance between two adjacent (neighboring) sub-bands/frequency supporting points) can be achieved at a sampling rate of 11,025 Hz. Due to the windowing, adjacent sub-bands are not independent of each other, and the real resolution is much lower. With the described refinement method, it is possible to achieve an enhanced frequency resolution of windowed speech signals, either by reducing the spectral overlap of adjacent sub-bands or by inserting additional frequency supporting points in between. As an example, a 512-FFT short-term spectrum (high FFT order) is determined out of a few previous 256-FFT short-term spectra (low FFT order). Computing additional frequency supporting points can improve, e.g., pitch estimation schemes or noise suppression algorithms. For echo cancellation purposes, this method improves neither the speed of convergence nor the steady state performance.

In view of the foregoing, a need exists to reduce the computational complexity of frequency domain or sub-band domain based speech enhancement systems that include echo cancellation filters.

SUMMARY OF EMBODIMENTS

Embodiments of the present invention exploit redundancy of succeeding FFT spectra and use this redundancy for computing interpolated temporal supporting points. Instead of calculating additional short-term spectra, embodiments of the present invention estimate additional short-term spectra between calculated short-term spectra. That is, a short-term spectrum is estimated for each pair of temporally adjacent calculated short-term spectra. The estimated short-term spectra effectively double the number of spectra available for echo cancellation or other signal processing purposes, without significantly increasing computational requirements and without introducing significant delay.

Due to simple temporal interpolation, there is no need for increased overlapping, no need for lower sub-sampling rates and, therefore, no need for calculating an increased number of short-term spectra. By using these temporally interpolated spectra in the adaptive filtering algorithm, aliasing effects in the filter parameters and, therefore, in an echo reduced synthesized microphone signal, can be reduced, and the performance of echo cancellation filters can be improved drastically. The adaptive filtering can be done with algorithms, such as the least mean square algorithm (NLMS), the normalized least mean square algorithm (NLMS), the recursive least squares algorithm (RLS) or affine projection algorithms. (See Hänsler). Significantly better steady state performance, such as less remaining echo after convergence, is achieved.

An embodiment of the present invention provides a method for echo compensation of at least one audio microphone signal. The microphone is part of a loudspeaker-microphone system. That is, the microphone operates in the presence of an acoustic signal generated by a loudspeaker. Thus, the microphone signal includes an echo signal contribution due to an audio loudspeaker signal. The method includes converting overlapped sequences of the audio loudspeaker signal from a time domain to a frequency domain and obtaining a time series of short-time loudspeaker spectra with a predetermined number of sub-bands. The sequences have a predetermined sequence length and an amount of overlapping of the overlapped sequences predetermined by a loudspeaker sub-sampling rate. The method also includes temporally interpolating the time series of short-time loudspeaker spectra. For each pair of temporally adjacent short-time loudspeaker spectra, the method includes calculating an interpolated short-time loudspeaker spectrum by weighted addition of the temporally adjacent short-time loudspeaker spectra. An estimated echo spectrum is computed with its sub-band components for at least one current loudspeaker spectrum by weighted adding of a current short-time loudspeaker spectrum and previous short-time loudspeaker spectra, up to a predetermined maximum time delay. First filter coefficients are used for weighting the current loudspeaker spectrum and the corresponding previous short-time loudspeaker spectra with increasing time delay. Second filter coefficients are used for weighting the interpolated short-time loudspeaker spectra temporally adjacent to the current loudspeaker spectrum and the corresponding previous short-time loudspeaker spectra. The first and second filter coefficients are estimated by an adaptive algorithm.

The method also includes converting overlapped sequences of the audio microphone signal from the time domain to the frequency domain and obtaining a time series of short-time microphone spectra with a predetermined number of sub-bands. The sequences have a predetermined sequence length and an amount of overlapping of the overlapped sequences predetermined by a microphone sub-sampling rate.

The time series of short-time microphone spectra of the microphone signal is adaptively filtered by at least subtracting a corresponding estimated echo spectrum from a corresponding microphone spectrum. The first and second filter coefficients are applied and sub-band components of the spectra are used for the subtraction. The method also includes converting the filtered time series of short-time spectra of the microphone signal to overlapped sequences of a filtered audio microphone signal and overlapping the sequences of the filtered audio microphone signal to generate an echo compensated audio microphone signal.

Optionally, the temporal interpolation of the time series of short-time loudspeaker spectra is simplified by applying an interpolation matrix P containing only few coefficients being significantly different from zero (sparseness of the matrix). In a truncated interpolation matrix P, all elements lower than about 0.01 are set to 0. The matrix P reduces the computational complexity. The interpolation matrix P is described as:

$$P = THH_1H_2^{\pm}\tilde{T}^{+}$$

with $$\tilde{H}_1 = [H0_{N\times r}],$$

$$\tilde{H}_2 = [0_{N\times r}H],$$

-continued and $$\tilde{T} = \begin{bmatrix} T & 0_{N/2+1\times N} \\ 0_{N/2+1\times N} & T \end{bmatrix}.$$

For an even better signal enhancement, the adaptive filtration optionally includes noise reduction applied after subtraction of the estimated echo spectrum. The adaptively filtering may include suppressing a residual echo and/or reducing noise, after subtracting the estimated echo spectrum.

Computational complexity can optionally be reduced and speech enhancement improved if the loudspeaker sub-sampling rate is less than or equal to about 0.75 times the sequence length (block overlap greater than about 25%) and greater than about 0.35 times the sequence length (block overlap lower than about 65%). The loudspeaker sub-sampling rate may be about 0.6 times the sequence length (block overlap about 40%).

Some embodiments involve a plurality of audio microphone signals. In these cases, the converting of the overlapped sequences of the audio microphone signal from the time domain to the frequency domain, the adaptively filtering of the time series of short-time microphone spectra of the microphone signal, the converting of the filtered time series of short-time spectra of the microphone signal and the overlapping of the sequences of the filtered audio microphone signal may be performed for each of the plurality of audio microphone signals.

Another embodiment of the present invention provides a signal processor system for echo compensation of at least one audio microphone signal. The microphone signal includes an echo signal contribution due to an audio loudspeaker signal in a loudspeaker-microphone system. The signal processor includes a loudspeaker analysis filter bank. The loudspeaker analysis filter bank is configured to convert overlapped sequences of the audio loudspeaker signal from a time domain to a frequency domain and to obtain a time series of short-time loudspeaker spectra with a predetermined number of sub-bands. The sequences have a predetermined sequence length and an amount of overlapping of the overlapped sequences predetermined by a loudspeaker sub-sampling rate. The system also includes a temporal interpolator configured to interpolate the time series of short-time loudspeaker spectra. For each pair of temporally adjacent short-time loudspeaker spectra, the interpolator computes an interpolated short-time loudspeaker spectrum by weighted addition of the temporally adjacent short-time loudspeaker spectra. The system also includes an echo spectrum estimator configured to compute an estimated echo spectrum with its sub-band components for at least one current loudspeaker spectrum by weighted addition of a current short-time loudspeaker spectrum and previous short-time loudspeaker spectra, up to a predetermined maximum time delay. First filter coefficients are used for weighting the current loudspeaker spectrum and the corresponding previous short-time loudspeaker spectra with increasing time delay. Second filter coefficients are used for weighting the interpolated short-time loudspeaker spectra temporally adjacent to the current loudspeaker spectrum and the corresponding previous short-time loudspeaker spectra. The first and second filter coefficients are estimated by an adaptive algorithm.

A microphone analysis filter bank is configured to convert overlapped sequences of the audio microphone signal from the time domain to the frequency domain and obtain a time series of short-time microphone spectra with a predetermined number of sub-bands. The sequences have a predetermined sequence length and an amount of overlapping of the overlapped sequences predetermined by a microphone sub-sampling rate. A synthesis filter bank is configured to convert the filtered time series of short-time spectra of the microphone signal to overlapped sequences of a filtered audio microphone signal. An adaptive filter is configured to adaptively filter the time series of short-time microphone spectra of the microphone signal by at least subtracting a corresponding estimated echo spectrum from a corresponding microphone spectrum. The first and second filter coefficients are applied and sub-band components of the spectra are used for the subtraction. A synthesis filter bank is configured to overlap the sequences of the filtered audio microphone signal to generate an echo compensated audio microphone signal.

The adaptive filter may include a residual echo suppressor and/or a noise reducer applied after the subtraction of the estimated echo spectrum. The loudspeaker sub-sampling rate may be less than or equal to about 0.75 times the sequence length and greater than about 0.35 times the sequence length. The loudspeaker sub-sampling rate may be about 0.6 times the sequence length.

The system may include a beamformer configured to beamform the adaptively filtered time series of short-time microphone spectra of a plurality of microphone signals to generate a combined filtered time series of short-time spectra of the plurality of microphone signals.

The system may include a hands-free telephony system, a speech recognition system and/or a vehicle communication system.

Yet another embodiment of the present invention provides a computer program product for providing echo compensation of at least one audio microphone signal that includes an echo signal contribution due to an audio loudspeaker signal in a loudspeaker-microphone system. The computer program product includes a non-transitory computer-readable medium having computer readable program code stored thereon. The computer readable program is configured to convert overlapped sequences of the audio loudspeaker signal from a time domain to a frequency domain and obtain a time series of short-time loudspeaker spectra with a predetermined number of sub-bands. The sequences have a predetermined sequence length and an amount of overlapping of the overlapped sequences predetermined by a loudspeaker sub-sampling rate. The computer readable program is also configured to temporally interpolate the time series of short-time loudspeaker spectra. For each pair of temporally adjacent short-time loudspeaker spectra, the program calculates an interpolated short-time loudspeaker spectrum by weighted addition of the temporally adjacent short-time loudspeaker spectra. The program is also configured to compute an estimated echo spectrum with its sub-band components for at least one current loudspeaker spectrum by weighted addition of a current short-time loudspeaker spectrum and previous short-time loudspeaker spectra, up to a predetermined maximum time delay. First filter coefficients are used for weighting the current loudspeaker spectrum and the corresponding previous short-time loudspeaker spectra with increasing time delay. Second filter coefficients are used for weighting the interpolated short-time loudspeaker spectra temporally adjacent to the current loudspeaker spectrum and the corresponding previous short-time loudspeaker spectra. The first and second filter coefficients are estimated by an adaptive algorithm. The program is also configured to convert overlapped sequences of the audio microphone signal from the time domain to the frequency domain and obtain a time series of short-time microphone spectra with a predetermined number of sub-bands. The sequences have a predetermined sequence length and an amount of overlapping of the overlapped sequences predetermined by a microphone sub-sampling rate. The program is also configured to adaptively filter the time series of short-time microphone spectra of the microphone signal by at least subtracting a corresponding estimated echo spectrum from a corresponding microphone spectrum. The first and second filter coefficients are applied and sub-band components of the spectra are used for the subtraction. The program is also configured to convert the filtered time series of short-time spectra of the microphone signal to overlapped sequences of a filtered audio microphone signal and overlap the sequences of the filtered audio microphone signal to generate an echo compensated audio microphone signal.

The sequence length of the audio loudspeaker signal sequences is preferably equal to the sequence length of the audio microphone signal sequences. If there is a difference in the sequence length of the audio loudspeaker and the microphone signal sequences, then the spectra or the filter coefficients may be adjusted in the frequency range in order to create values for corresponding sub-bands.

The loudspeaker sub-sampling rate defines the clock pulse at which audio loudspeaker signal sequences are transformed to short-time loudspeaker spectra. The estimation of the echo components (filter coefficients) is made with a doubled number of short-time loudspeaker spectra, namely the Fourier transforms of the audio loudspeaker signal sequences and the temporally interpolated spectra thereof. This doubled number of spectra used in each echo estimation reduces the unwanted effects of aliasing. The echo components (filter coefficients) are computed at the clock pulse rate of the loudspeaker sub-sampling rate and will be used as the microphone sub-sampling rate. If the loudspeaker and the microphone sub-sampling rates would be different, then an additional step would be needed to calculate filter coefficients at a clock pulse corresponding to the microphone sub-sampling rate. In an embodiment of the invention, the predetermined loudspeaker sub-sampling rate is equal to the predetermined microphone sub-sampling rate (the amount of overlapping of the overlapped audio loudspeaker signal sequences is equal to the amount of overlapping of the overlapped audio microphone signal sequences) and therefore the filter coefficients can be directly applied to the adaptive filtering of the time series of short-time microphone spectra.

As a result, good echo performance, namely a damping of about at least 30 dB, can be achieved, even at high sub-sampling rates, i.e., with a small overlap of adjacent signal waveform sequences to be transformed into spectra. Experiments with echo cancellation have shown that the overlapping of adjacent segments extracted from the input signal can be reduced to about 40% (meaning that with a block size of 256, a sub-sampling rate up to about 150 can be chosen). Without the disclosed temporal interpolation of spectra, the sub-sampling rate would have to be much smaller and the overlap would have to be much larger. The disclosed method and apparatus are able to produce performance comparable to the method disclosed in EP1936939A1, but with lower complexity and without performing additional FFTs or using different sub-sampling rates. The lowering of the computational complexity represents a reduction of about 30 to 50%, compared to state of the art approaches. Interpolations include fewer operations than transformations into the frequency domain would include.

The temporally interpolated spectra reduce the negative aliasing effects at a much higher sub-sampling rate. The adaptive algorithm for computing an estimated echo spectrum uses first and second filter coefficients. For the same temporal length of the impulse response of the loudspeaker-room-microphone system, the use of first and second filter coefficients leads to twice as many filter coefficients and allows for a better estimate of the echo contribution.

The complexity reduction is possible without increasing the delay inserted in the signal path of the entire system and without reducing the performance of the system in terms of adaptation speed and steady state performance, below predefinable thresholds.

Additional memory may be needed for the filter coefficients of an echo cancellation unit.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

The present invention generally relates to speech enhancement technology applied in various applications, such as hands-free telephone systems, speech dialog systems or in-car communication systems. At least one loudspeaker and at least one microphone are required for the above mentioned application examples.

Embodiments of the present invention can be used in any adaptive system that operates in the frequency domain or sub-band domain and is used for signal cancellation purposes. Examples of such applications are network echo cancellation, cross-talk cancellation (where neighbouring channels have to be cancelled), active noise control (where undesired distortions have to be cancelled), or fetal heart rate monitoring (where a heartbeat of a mother has to be cancelled).

Estimated echo spectra of conventional echo cancellation systems are computed by adding weighted sums of current and previous spectra of loudspeaker signals:

$$\hat{d}_{DFT}(n) = \sum_{i=0}^{M-1} W_i(n) x_{DFT}(n-i).$$

M stands for the amount of previous spectra that are used for the computation of the estimated echo spectra. The matrices $W_i(n)$ are diagonal matrixes containing coefficients of the adaptive sub-band filters:

$$W_i(n) = diag\{w_i(n)\} = \begin{bmatrix} w_{i,0}(n) & 0 & 0 & \dots & 0 \\ 0 & w_{i,1}(n) & 0 & \dots & 0 \\ 0 & 0 & w_{i,2}(n) & & 0 \\ \vdots & \vdots & & \ddots & \vdots \\ 0 & 0 & 0 & \dots & w_{i,N/2}(n) \end{bmatrix}.$$

N stands for the order of the discrete Fourier transform (DFT), where only N/2+1 sub-bands are computed due to the conjugate complex symmetry of the remaining sub-bands.

As disclosed in Hänsler, the filter coefficients are usually updated with a gradient-based adaptation rule, such as the normalized least mean square algorithm (NLMS), the affine projection algorithm or the recursive least squares algorithm (RLS). This causes problems, if the sub-sampling rate (which is equal to the number of samples between two frames) is chosen too high. These problems can be reduced by inserting temporally interpolated spectra and computing the estimated echo spectra as:

$$\hat{d}_{DFT}(n) = \sum_{i=0}^{M-1} W_i(n) x_{DFT}(n-i) + \sum_{i=0}^{M-1} W'_i(n) x'_{DFT}(n-i).$$

The overall number of filter coefficients does not have to change significantly, since the parameter M can be chosen much lower when using the interpolated spectra, and thus a higher sub-sampling rate can be applied. Previous solutions only use the non-interpolated spectra and a much higher value for the parameter M:

$$\hat{d}_{DFT,conventional}(n) = \sum_{i=0}^{M-1} W_i(n) x_{DFT}(n-i).$$

The new filter coefficients $W'_i(n)$ can be updated using, e.g., the NLMS algorithm.

Figure 1:
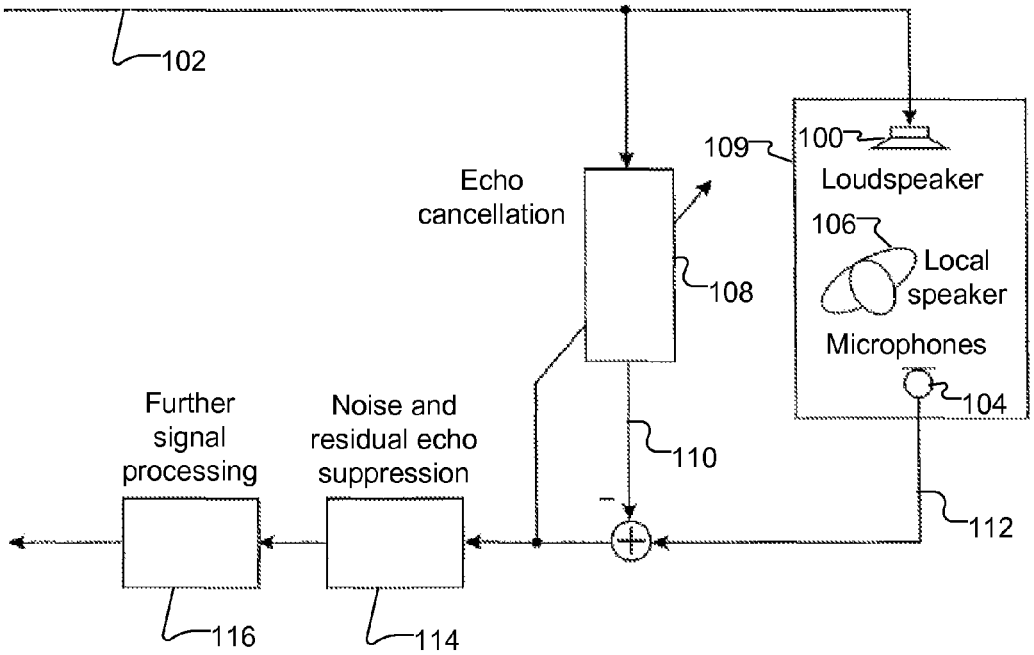
(Prior Art) Fig. 1
FIG. 1 is a schematic block diagram of a prior art time domain speech enhancement system.
Figure 2:
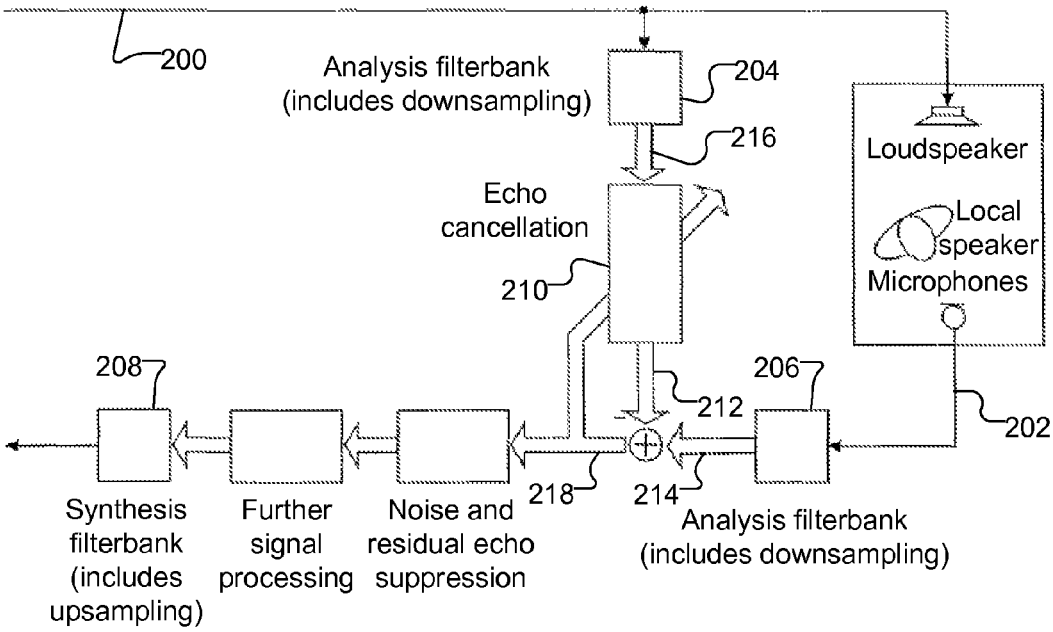
(Prior Art) Fig. 2
FIG. 2 is a schematic block diagram of a prior art frequency-domain speech enhancement system.
Figure 3:
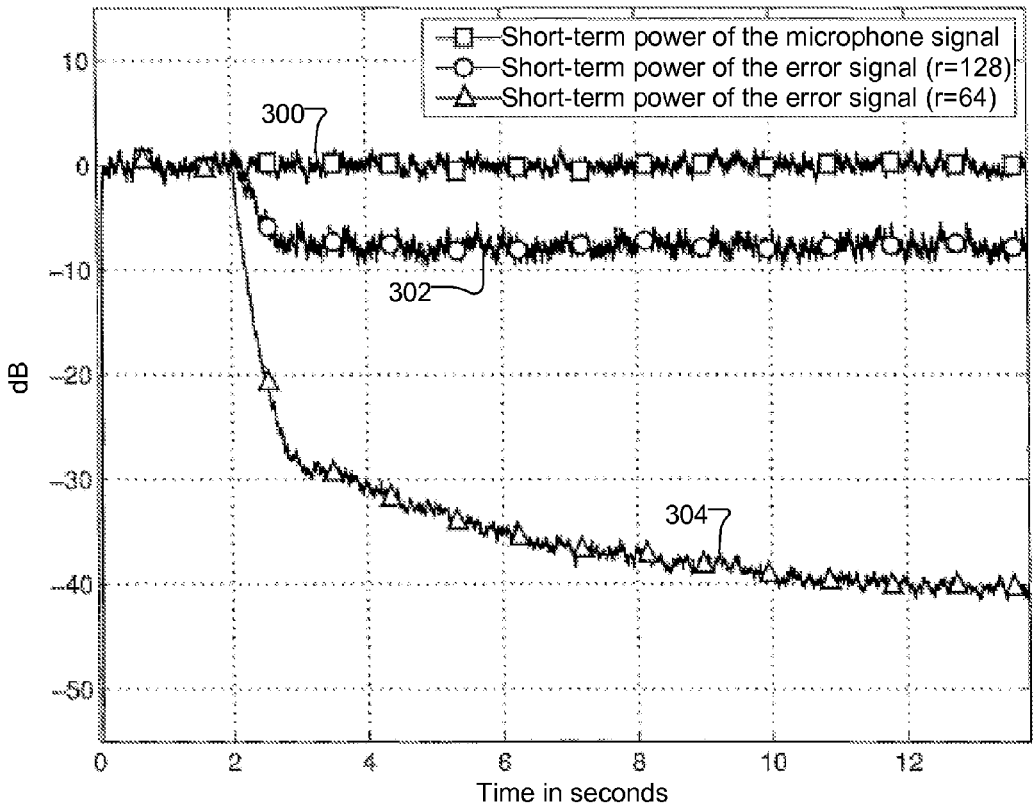
(Prior Art) Fig. 3
FIG. 3 is a graph depicting signal power time series of a sub-band echo cancellation system for an input signal and for enhanced signals using two different sub-sampling rates, as is known in the prior art.
Figure 4:
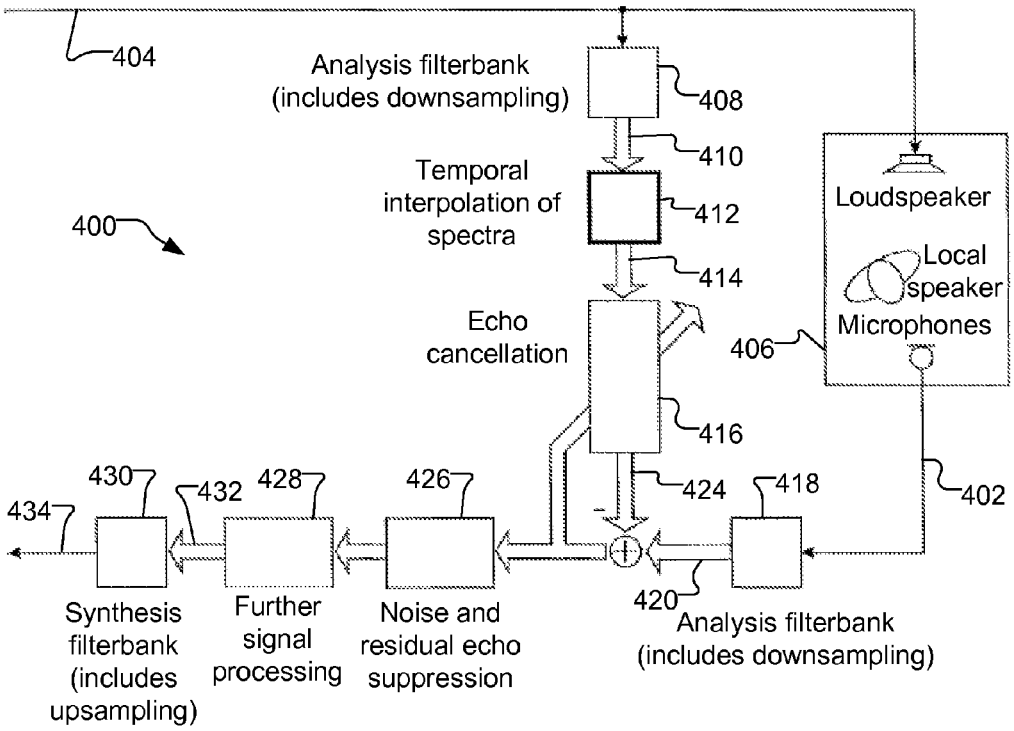
FIG. 4 is a schematic block diagram of a speech enhancement system that includes time-frequency interpolation, according to an embodiment of the present invention.

FIG. 4 shows a basic structure of one embodiment of an echo compensation system 400. At least one audio microphone signal 402 includes an echo signal contribution, due to an audio loudspeaker signal 404 in a loudspeaker-microphone system 406. The audio loudspeaker signal 404 is fed to an analysis filter bank 408, which includes sub-sampling (downsampling). The analysis filter bank 408 converts overlapped sequences of the audio loudspeaker signal 404 from the time domain to a frequency domain and obtains a time series of short-time loudspeaker spectra with a predetermined number of sub-bands, where the sequences have a predetermined sequence length, and an amount of overlapping of the overlapped sequences is predetermined by a loudspeaker sub-sampling rate. The output 410 of the analysis filter bank 408 is fed to temporal interpolator of spectra 412 (time-frequency interpolator), which temporally interpolates the time series of short-time loudspeaker spectra 410. The output 414 of the time-frequency interpolation is fed to an echo canceller 416, which computes an estimated echo spectrum with its sub-band components for each current loudspeaker spectrum by weighted addition of the current short-time loudspeaker spectrum and of previous short-time loudspeaker spectra, up to a predetermined maximum time delay. First filter coefficients are used for weighting the current loudspeaker spectrum and the corresponding previous short-time loudspeaker spectra with increasing time delay. Second filter coefficients are used for weighting the interpolated short-time loudspeaker spectra temporally adjacent the current loudspeaker spectrum and the corresponding previous short-time loudspeaker spectra. The first and second filter coefficients are estimated by an adaptive algorithm.

A microphone analysis filter bank 418, which includes downsampling, converts overlapped sequences of the audio microphone signal 402 from the time domain to a frequency domain and thereby obtains a time series of short-time microphone spectra 420 with a predetermined number of sub-bands, where the sequences have a predetermined sequence length and an amount of overlapping of the overlapped sequences predetermined by a microphone sub-sampling rate.

At the plus sign in the circle 422, at least adaptive filtering of the time series of short-time microphone spectra is processed by subtracting a corresponding estimated echo spectrum 424 from a corresponding microphone spectrum 420, where the first and second filter coefficients are used to subtract estimated sub-band components from the sub-band components of the short-time microphone spectra. After this adaptive echo filtering, further signal enhancement can be applied. FIG. 4 shows an optional noise and residual echo suppressor 426 and an optional further signal processor 428 in the frequency domain. After the signal enhancement, a synthesis filter bank 430, which includes upsampling, converts the filtered time series of short-time spectra 432 of the microphone signal to overlaps sequences of a filtered audio microphone signal and overlaps the sequences of the filtered audio microphone signal to generate an echo compensated audio microphone signal 434.

Figure 5:
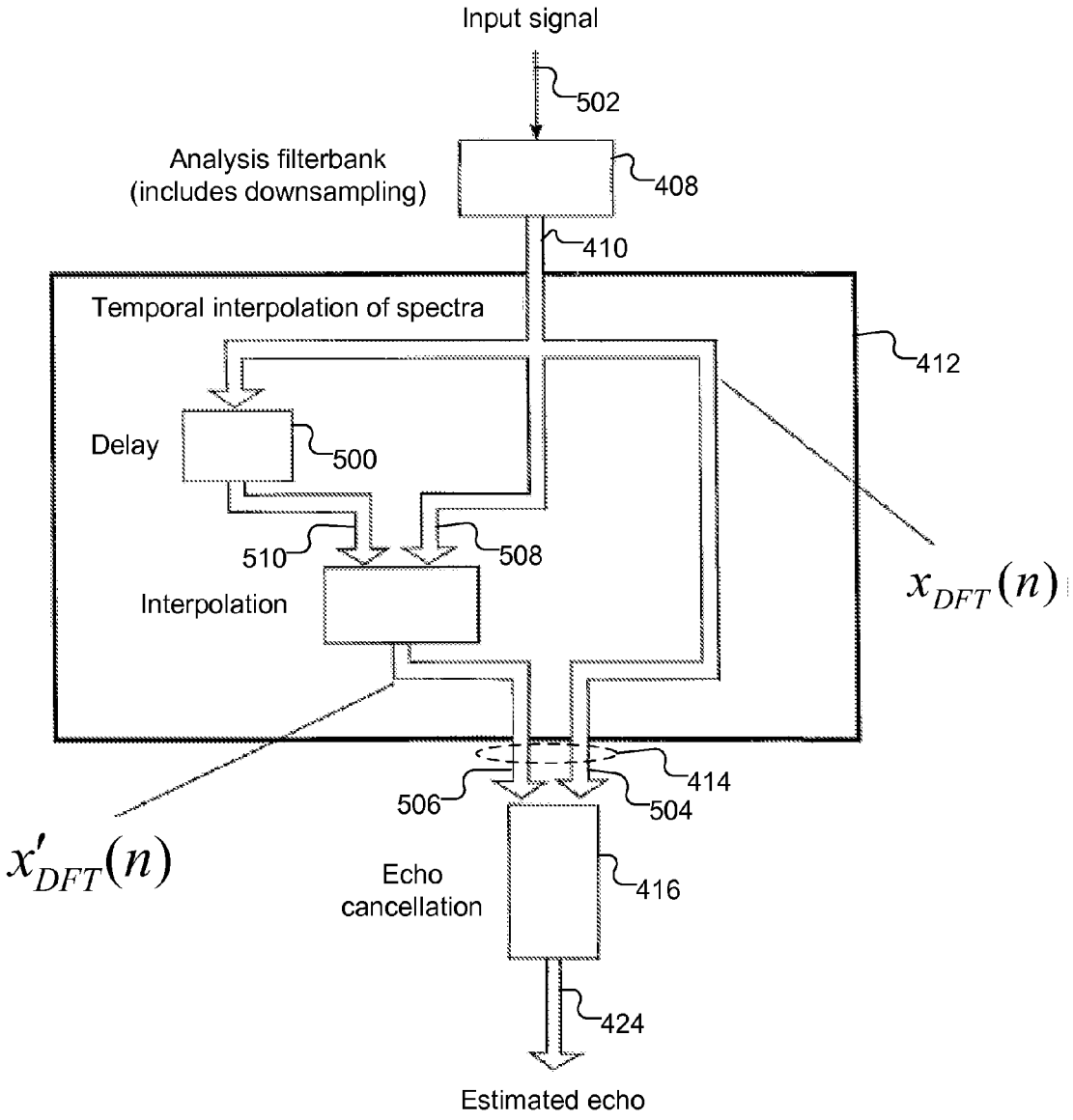
FIG. 5 is a detailed schematic block diagram of a temporal interpolator of spectra of FIG. 4, according to an embodiment of the present invention.

FIG. 5 shows details of the temporal interpolator 412 (FIG. 4), where, for each pair of temporally adjacent short-time loudspeaker spectra, an interpolated short-time loudspeaker spectrum is computed by weighted addition of the temporally adjacent short-time loudspeaker spectra. Temporally adjacent short-time loudspeaker spectra are generated by a delay module 500. The output of the time-frequency interpolation includes a current loudspeaker spectrum 504 and an interpolated short-time loudspeaker spectrum 506 adjacent the current loudspeaker spectrum 504. These spectra 504 and 506 are fed to the echo cancellation module 416, which adaptively estimates echo components to be subtracted from the corresponding microphone spectrum.

Note that the basic adaptation scheme, which is typically a gradient-based optimization procedure, need not to be changed. The same adaptation rule, which is applied in conventional schemes for updating the coefficients $W_i(n)$, can be applied to update the additional coefficients $W'_i(n)$.

The interpolated spectra 506 are computed by weighted addition of a current 508 and a previous 510 loudspeaker spectra:

$$x'_{DFT}(n) = P\begin{bmatrix} x_{DFT}(n) \\ x_{DFT}(n-1) \end{bmatrix}.$$

The analysis filter bank 408 segments the input signal 502 x(n) into overlapping blocks of appropriate block size N, applying a sub-sampling rate r and therefore a corresponding overlap (e.g., using a FFT size of N=256 and a sub-sampling rate of r=128; an overlap of 50% is applied). Successive frames are correlated. Embodiments of the present invention exploit the correlation, or to be more precise, the redundancy of successive input signal frames, to extrapolate an additional signal frame in between the originally overlapped signal frames. Thus, the interpolated signal frame (interpolated temporal supporting points) corresponds to a signal block which would be computed with an analysis filter bank at a reduced, or to be more precise, at half of the original sub-sampling rate. This would be an overlap of 25% at a sub-sampling rate of 64 with a 256-FFT.

Computing the weighting matrix P with a dimension of [(N+2)×1] is described below. The loudspeaker spectra are computed by first extracting a vector containing the last N samples of the loudspeaker signals:

$$x(n)=[x(n),x(n-1),\ldots,x(n-N+1)]^T.$$

In the time space of x(n), the variable n corresponds to time. The vector x(n) is windowed with a window function (e.g., a Hann window) described by a vector:

$$h=[h_0,h_1,\ldots,h_{N-1}]^T.$$

For transforming a windowed input vector into the DFT domain, we define a transformation matrix:

$$T = \begin{bmatrix} e^{-j\frac{2\pi}{N}\cdot 0\cdot 0} & e^{-j\frac{2\pi}{N}\cdot 0\cdot 1} & e^{-j\frac{2\pi}{N}\cdot 0\cdot 2} & \ldots & e^{-j\frac{2\pi}{N}\cdot 0\cdot (N-1)} \\ e^{-j\frac{2\pi}{N}\cdot 1\cdot 0} & e^{-j\frac{2\pi}{N}\cdot 1\cdot 1} & e^{-j\frac{2\pi}{N}\cdot 1\cdot 2} & \ldots & e^{-j\frac{2\pi}{N}\cdot 1\cdot (N-1)} \\ e^{-j\frac{2\pi}{N}\cdot 2\cdot 0} & e^{-j\frac{2\pi}{N}\cdot 2\cdot 1} & e^{-j\frac{2\pi}{N}\cdot 2\cdot 2} & & e^{-j\frac{2\pi}{N}\cdot 2\cdot (N-1)} \\ \vdots & \vdots & & \ddots & \vdots \\ e^{-j\frac{2\pi}{N}\cdot\frac{N}{2}\cdot 0} & e^{-j\frac{2\pi}{N}\cdot\frac{N}{2}\cdot 1} & e^{-j\frac{2\pi}{N}\cdot\frac{N}{2}\cdot 2} & \ldots & e^{-j\frac{2\pi}{N}\cdot\frac{N}{2}\cdot (N-1)} \end{bmatrix}.$$

Using this matrix, the loudspeaker spectrum becomes:

$$x_{DFT}(n)=THx(nr).$$

Note that this transformation is computed on a sub-sampled basis, described by the sub-sampling rate r (also denoted as "frameshift" in the literature). For the spectrum $x_{DFT}(n)$, the variable n corresponds to the number of the spectrum and therefore to the number of the block of the input signal x(n) transformed to this spectrum. The sub-sampled loudspeaker signals are therefore defined according to:

$$x(nr)=[x(nr),x(nr-1),\ldots,x(nr-N+1)]^T.$$

The term nr is a product and indicates the time or position where the actual block starts.

The matrix H is a diagonal matrix and contains the window coefficients:

$$H = diag\{h\} = \begin{bmatrix} h_0 & 0 & 0 & \ldots & 0 \\ 0 & h_1 & 0 & \ldots & 0 \\ 0 & 0 & h_2 & & 0 \\ \vdots & \vdots & & \ddots & \vdots \\ 0 & 0 & 0 & \ldots & h_{N-1} \end{bmatrix}.$$

For computing the interpolation matrix, we define first an extended matrix of the filter coefficients:

$$H_1=[0_{N\times r/2}H0_{N\times r/2}].$$

This means we add N×r/2 zeros before the original (diagonal) window matrix and N×r/2 behind. Since we need r/2 zeros, we assume the sub-sampling rate to be an even quantity. In addition, a second extended window matrix is computed according to:

$$H_2=\begin{bmatrix}\tilde{H}_1\\ \tilde{H}_2\end{bmatrix},$$

with $$\tilde{H}_1=[H\quad 0_{N\times r}],$$

and $$\tilde{H}_2=[0_{N\times r}\quad H].$$

Finally, an extended transformation matrix is defined as:

$$\tilde{T}=\begin{bmatrix}T & 0_{N/2+1\times N}\\ 0_{N/2+1\times N} & T\end{bmatrix}.$$

After defining all necessary matrices used for the derivation of P, the interpolated spectra may be reformulated as follows:

$$x'_{DFT}(n)=P\tilde{T}H_2\tilde{x}(nr)=TH_1\tilde{x}(nr),$$

where $$\tilde{x}(nr)=[x(nr),x(nr-1),\ldots x(n-N+r+1)]^T$$

characterize an extended input signal frame containing the last N+r samples of the loudspeaker signal. The interpolation matrix P can be computed according to:

$$P=TH_1H_2^+\tilde{T}^+.$$

Here, the Moore Penrose inverse has been used, which is defined as:

$$A^+=[\mathrm{adj}\{A\}A]^{-1}\mathrm{adj}\{A\}.$$

The abbreviation adj { . . . } defines the adjoint of a matrix.

For sub-band echo cancellation, the microphone signal y(n) also has be segmented into overlapping blocks. The overlapping of the input segments is modelled by the sub-sampling factor r according to:

$$y(nr)=[y(nr),y(nr-1),\ldots y(nr-N+1)]^T.$$

Applying a DFT to the windowed and sub-sampled microphone signal segments results in a short-term spectrum of the current frame:

$$y_{DFT}(n)=THy(nr).$$

Echo reduction is achieved by subtracting the estimated echo sub-band components from the microphone sub-band components according to:

$$\hat{e}_{DFT}(n)=y_{DFT}(n)-\hat{d}_{DFT}(n).$$

The error sub-band signal is used as input for subsequent speech enhancement algorithms (such as residual echo suppression to reduce remaining echo components or noise suppression to reduce background noise) and for adapting the filter coefficients of the echo canceller (e.g., with the NLMS algorithm). The echo-reduced spectra are transformed back into the time domain using a synthesis filter bank.

The disclosed system and method allow for a significant increase of the sub-sampling rate and thus for a significant reduction of the computational complexity for a speech enhancement system. We will show some results demonstrating the performance of the disclosed system and method below. In prior art systems, the computation of the temporally interpolated spectrum is quite costly. However, the matrix P contains only few coefficients that are significantly different than zero (sparseness of the matrix). Thus, the computation can be approximated very efficiently as described below.

Figure 6:
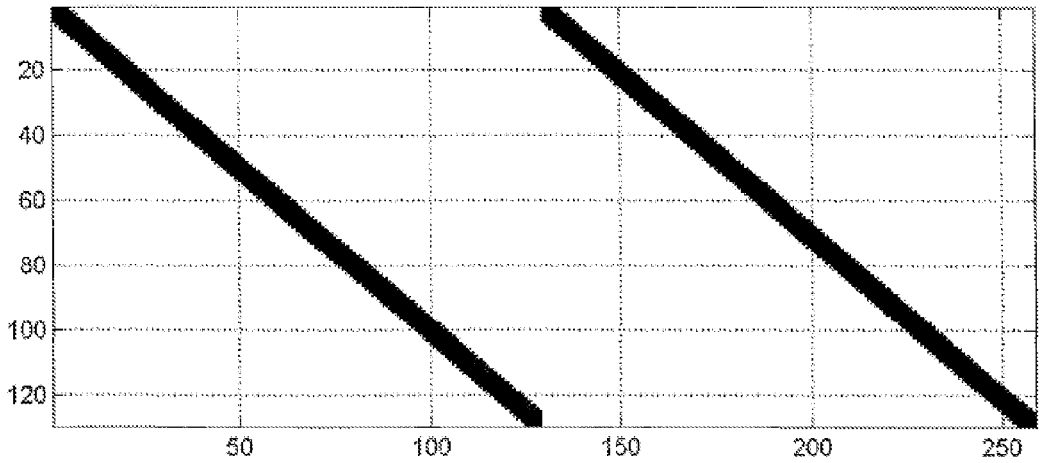
FIG. 6 is a graph facilitating visualization of an interpolation matrix P and a simplified version thereof, where all elements are plotted in decibels (20 log 10 of magnitude), according to an embodiment of the present invention.

As described above, the matrix P is a very sparse matrix. This results from the diagonal structure of the matrix H, from the sparseness of the extended window matrices $H_1$ and $H_2$, and from the orthogonal eigenfunctions included in the transformation matrices. Thus, it is sufficient to use only about five to ten complex multiplications and additions to compute one interpolated sub-band (instead of 2×(N/2+1)). This results in a computational complexity lower than the one required in the prior art. FIG. 6 shows the log-magnitudes of the elements of the truncated interpolation matrix P, where all elements less than about 0.01 are set to 0 and where for visualisation all elements greater than about 0.01 are set to 1 and displayed in black. The elements that are greater than about 0.01 are used in the calculations with their actual values. For an FFT size of N=256, the matrix P has a size of 256 (x-direction) times 128 (y-direction). Non-zero values are depicted in black and reveal the sparseness of the matrix P.

Figure 7:
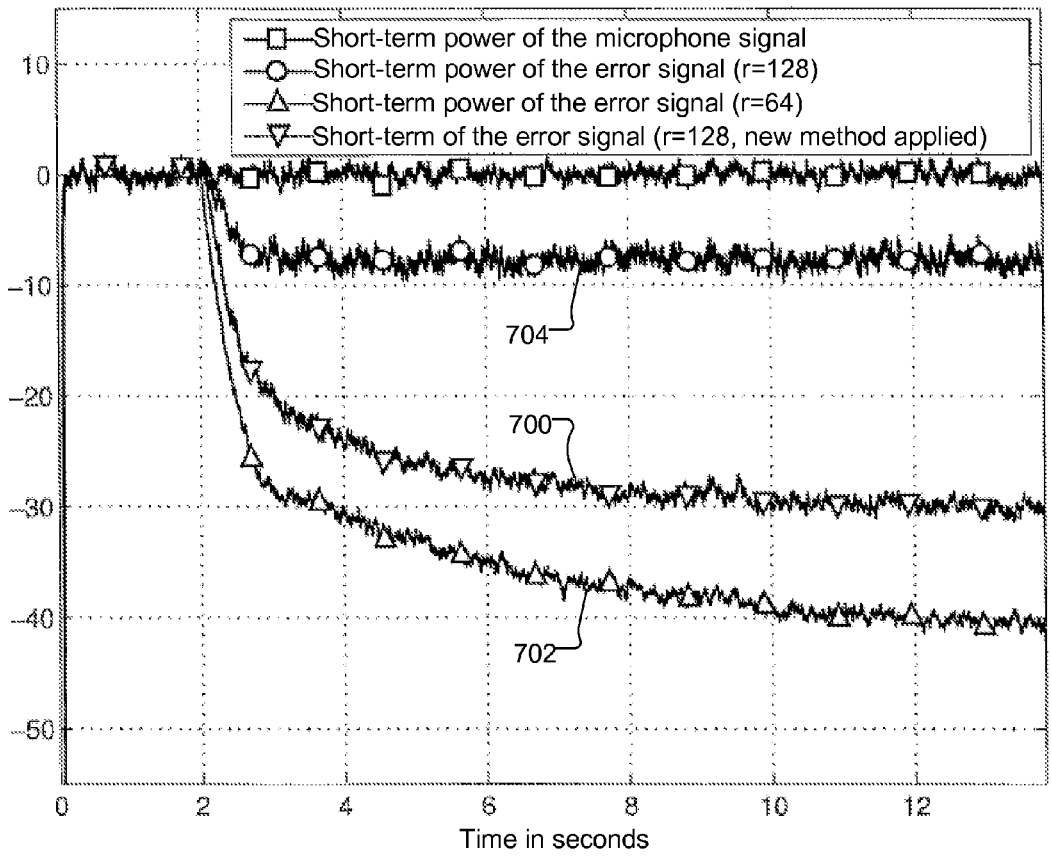
FIG. 7 is a graph depicting performance of sub-band echo cancellation systems for two different sub-sampling rates, according to embodiments of the present invention. For the higher rate curve (r=128), the disclosed method was applied in addition, leading to the lower curve (r=128, new method applied).

In order to show the performance of the new method, the simulation from above has been repeated, now applying the simplified interpolation matrix as shown in FIG. 6. In FIG. 7, the third signal from the top (signal 700) shows the results of the disclosed method. The complexity is about 50%, compared to the prior art method (signal 702), meaning that a sub-sampling rate of 128 has been used. Compared to the direct application of this sub-sampling rate (signal 704), a significant improvement in terms of echo reduction can be achieved. Before, only about 8 dB were possible; now about 30 dB are achievable. However, the performance (about 40 dB) of the prior art setup with a sub-sampling rate of 64 cannot be achieved, but in a real system, usually the performance is limited to about 30 dB due to background noise and other limiting factors.

Figure 8:
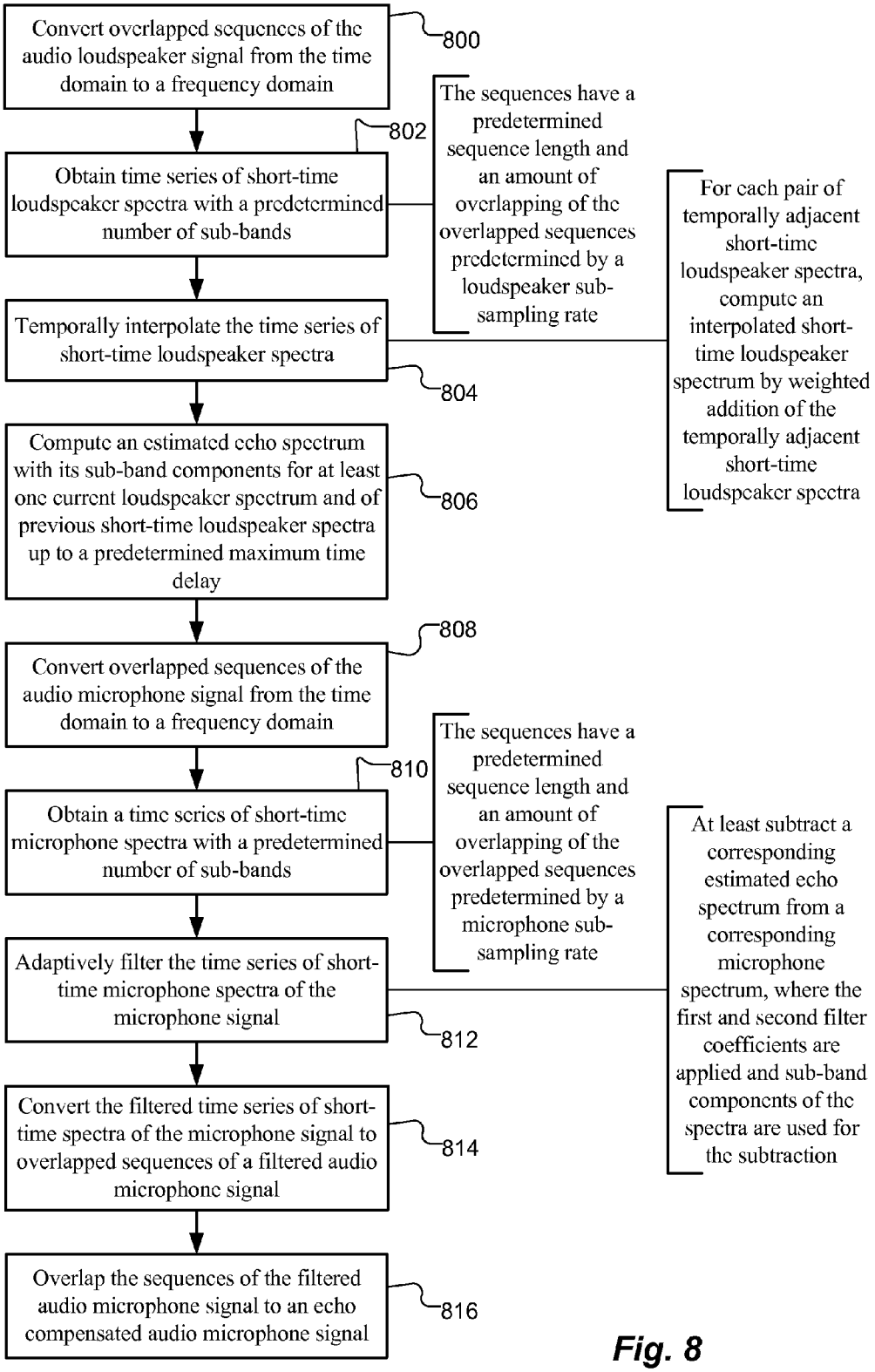
FIG. 8 is a flowchart illustrating a process for echo compensation, according to an embodiment of the present invention.

FIG. 8 is a flowchart illustrating a process for echo compensation. At 800, overlapped sequences of the audio loudspeaker signal are converted from a time domain to a frequency domain. At 802, a time series of short-time loudspeaker spectra is obtained with a predetermined number of sub-bands. The sequences have a predetermined sequence length and an amount of overlapping of the overlapped sequences predetermined by a loudspeaker sub-sampling rate. At 804, the time series of short-time loudspeaker spectra are temporarily interpolated. For each pair of temporally adjacent short-time loudspeaker spectra, an interpolated short-time loudspeaker spectrum is computed by weighted addition of the temporally adjacent short-time loudspeaker spectra. At 806, an estimated echo spectrum is computed with its sub-band components for at least one current loudspeaker spectrum by weighted addition of the current short-time loudspeaker spectrum and of previous short-time loudspeaker spectra, up to a predetermined maximum time delay. First filter coefficients are used for weighting the current loudspeaker spectrum and the corresponding previous short-time loudspeaker spectra with increasing time delay. Second filter coefficients are used for weighting the interpolated short-time loudspeaker spectra temporally adjacent the current loudspeaker spectrum and the corresponding previous short-time loudspeaker spectra. The first and second filter coefficients are estimated by an adaptive algorithm.

At 808, overlapped sequences of the audio microphone signal are converted from the time domain to a frequency domain. At 810, a time series of short-time microphone spectra are obtained with a predetermined number of sub-bands. The sequences have a predetermined sequence length and an amount of overlapping of the overlapped sequences predetermined by a microphone sub-sampling rate. At 812, the time series of short-time microphone spectra of the microphone signal are adaptively filtered by at least subtracting a corresponding estimated echo spectrum from a corresponding microphone spectrum, where the first and second filter coefficients are applied and sub-band components of the spectra are used for the subtraction. At 814, the filtered time series of short-time spectra of the microphone signal are converted to overlapped sequences of a filtered audio microphone signal. At 818, the sequences of the filtered audio microphone signal is overlapped to generate an echo compensated audio microphone signal.

Embodiments of the above-described echo compensator, or components thereof, may be implemented by a processor controlled by instructions stored in a memory. The memory may be random access memory (RAM), read-only memory (ROM), flash memory or any other memory, or combination thereof, suitable for storing control software or other instructions and data. Some of the functions performed by the echo compensator have been described with reference to flowcharts and/or block diagrams. Those skilled in the art should readily appreciate that functions, operations, decisions, etc. of all or a portion of each block, or a combination of blocks, of the flowcharts or block diagrams may be implemented as computer program instructions, software, hardware, firmware or combinations thereof. Those skilled in the art should also readily appreciate that instructions or programs defining the functions of the present invention may be delivered to a processor in many forms, including, but not limited to, information permanently stored on tangible non-writable storage media (e.g., read-only memory devices within a computer, such as ROM, or devices readable by a computer I/O attachment, such as CD-ROM or DVD disks), information alterably stored on tangible writable storage media (e.g., floppy disks, removable flash memory and hard drives) or information conveyed to a computer through communication media, including wired or wireless computer networks. In addition, while the invention may be embodied in software, the functions necessary to implement the invention may optionally or alternatively be embodied in part or in whole using firmware and/or hardware components, such as combinatorial logic, Application Specific Integrated Circuits (ASICs), Field-Programmable Gate Arrays (FPGAs) or other hardware or some combination of hardware, software and/or firmware components.

While the invention is described through the above-described exemplary embodiments, it will be understood by those of ordinary skill in the art that modifications to, and variations of, the illustrated embodiments may be made without departing from the inventive concepts disclosed herein. For example, although some aspects of the echo compensator have been described with reference to a flowchart, those skilled in the art should readily appreciate that functions, operations, decisions, etc. of all or a portion of each block, or a combination of blocks, of the flowchart may be combined, separated into separate operations or performed in other orders. Furthermore, disclosed aspects, or portions of these aspects, may be combined in ways not listed above. Accordingly, the invention should not be viewed as being limited to the disclosed embodiments.

What is claimed is:

1. A method for echo compensation of at least one audio microphone signal that includes an echo signal contribution due to an audio loudspeaker signal in a loudspeaker-microphone system, the method comprising:

converting overlapped sequences of the audio loudspeaker signal from a time domain to a frequency domain and obtaining a time series of short-time loudspeaker spectra with a predetermined number of sub-bands, wherein the sequences have a predetermined sequence length and an amount of overlapping of the overlapped sequences predetermined by a loudspeaker sub-sampling rate;

temporally interpolating the time series of short-time loudspeaker spectra, including, for each pair of temporally adjacent short-time loudspeaker spectra, calculating an interpolated short-time loudspeaker spectrum by weighted addition of the temporally adjacent short-time loudspeaker spectra;

computing an estimated echo spectrum with its sub-band components for at least one current loudspeaker spectrum by weighted adding of a current short-time loudspeaker spectrum and previous short-time loudspeaker spectra, up to a predetermined maximum time delay, wherein:

first filter coefficients are used for weighting the current loudspeaker spectrum and the corresponding previous short-time loudspeaker spectra with increasing time delay;

second filter coefficients are used for weighting the interpolated short-time loudspeaker spectra temporally adjacent to the current loudspeaker spectrum and the corresponding previous short-time loudspeaker spectra; and the first and second filter coefficients are estimated by an adaptive algorithm; converting overlapped sequences of the audio microphone signal from the time domain to the frequency domain and obtaining a time series of short-time microphone spectra with a predetermined number of sub-bands, wherein the sequences have a predetermined sequence length and an amount of overlapping of the overlapped sequences predetermined by a microphone sub-sampling rate;

adaptively filtering the time series of short-time microphone spectra of the microphone signal by at least subtracting a corresponding estimated echo spectrum from a corresponding microphone spectrum, where the first and second filter coefficients are applied and sub-band components of the spectra are used for the subtraction;

converting the filtered time series of short-time spectra of the microphone signal to overlapped sequences of a filtered audio microphone signal; and overlapping the sequences of the filtered audio microphone signal to generate an echo compensated audio microphone signal.

2. The method according to claim 1, where the step of temporally interpolating the time series of short-time loudspeaker spectra is made by applying an interpolation matrix P, wherein:

$$P = THH_1 H_2^{+} \tilde{T}^{+}$$

with $$\tilde{H}_1 = [H 0_{N\times r}],$$

$$\tilde{H}_2 = [0_{N\times r} H],$$

and $$\tilde{T} = \begin{bmatrix} T & 0_{N/2+1\times N} \\ 0_{N/2+1\times N} & T \end{bmatrix}.$$

wherein T is a transformation matrix, H is a diagonal matrix containing window coefficients, $H_1$ is a first extended matrix of the filter coefficients, $H_2$ is a second extended matrix, r is the sub-sampling rate, and N is the number of samples.

3. A method according to claim 1, wherein the adaptively filtering comprises suppressing a residual echo, after subtracting the estimated echo spectrum.

4. A method according claim 1, wherein the adaptively filtering comprises reducing noise, after subtracting the estimated echo spectrum.

5. A method according claim 1, wherein the loudspeaker sub-sampling rate is not greater than about 0.75 times the sequence length and greater than about 0.35 times the sequence length.

6. A method according to claim 5, where the loudspeaker sub-sampling rate is about 0.6 times the sequence length.

7. A method according to claim 1, wherein converting the overlapped sequences of the audio microphone signal from the time domain to the frequency domain, the adaptively filtering the time series of short-time microphone spectra of the microphone signal, the converting the filtered time series of short-time spectra of the microphone signal and the overlapping the sequences of the filtered audio microphone signal are performed for each of a plurality of audio microphone signals.

8. A signal processor system for echo compensation of at least one audio microphone signal that includes an echo signal contribution due to an audio loudspeaker signal in a loudspeaker-microphone system, the signal processor system comprising:

a loudspeaker analysis filter bank configured to convert overlapped sequences of the audio loudspeaker signal from a time domain to a frequency domain and to obtain a time series of short-time loudspeaker spectra with a predetermined number of sub-bands, wherein the sequences have a predetermined sequence length and an amount of overlapping of the overlapped sequences predetermined by a loudspeaker sub-sampling rate;

a temporal interpolator configured to interpolate the time series of short-time loudspeaker spectra, including, for each pair of temporally adjacent short-time loudspeaker spectra, computing an interpolated short-time loudspeaker spectrum by weighted addition of the temporally adjacent short-time loudspeaker spectra;

an echo spectrum estimator having a computer processor configured to compute an estimated echo spectrum with its sub-band components for at least one current loudspeaker spectrum by weighted addition of a current short-time loudspeaker spectrum and previous short-time loudspeaker spectra, up to a predetermined maximum time delay, wherein:

first filter coefficients are used for weighting the current loudspeaker spectrum and the corresponding previous short-time loudspeaker spectra with increasing time delay;

second filter coefficients are used for weighting the interpolated short-time loudspeaker spectra temporally adjacent to the current loudspeaker spectrum and the corresponding previous short-time loudspeaker spectra; and the first and second filter coefficients are estimated by an adaptive algorithm;

a microphone analysis filter bank configured to convert overlapped sequences of the audio microphone signal from the time domain to the frequency domain and obtain a time series of short-time microphone spectra with a predetermined number of sub-bands, wherein the sequences have a predetermined sequence length and an amount of overlapping of the overlapped sequences predetermined by a microphone sub-sampling rate;

a synthesis filter bank configured to convert the filtered time series of short-time spectra of the microphone signal to overlapped sequences of a filtered audio microphone signal;

an adaptive filter configured to adaptively filter the time series of short-time microphone spectra of the microphone signal by at least subtracting a corresponding estimated echo spectrum from a corresponding microphone spectrum, where the first and second filter coefficients are applied and sub-band components of the spectra are used for the subtraction; and a synthesis filter bank configured to overlap the sequences of the filtered audio microphone signal to generate an echo compensated audio microphone signal.

9. A signal processor system according to claim 8, wherein the adaptive filter comprises a residual echo suppressor applied after the subtraction of the estimated echo spectrum.

10. A signal processor system according to claim 8, wherein the adaptive filter comprises a noise reducer applied after the subtraction of the estimated echo spectrum.

11. A signal processor system according to claim 8, wherein the loudspeaker sub-sampling rate is not greater than about 0.75 times the sequence length and greater than about 0.35 times the sequence length.

12. A signal processor system according to claim 11, wherein the loudspeaker sub-sampling rate is about 0.6 times the sequence length.

13. A signal processor system according to claim 8, further comprising a beamformer configured to beamform the adaptively filtered time series of short-time microphone spectra of a plurality of microphone signals to generate a combined filtered time series of short-time spectra of the plurality of microphone signals.

14. A signal processor system according to claim 8, further comprising a hands-free telephony system.

15. A signal processor system according to claim 8, further comprising a speech recognition system.

16. A signal processor system according to claim 8, further comprising a vehicle communication system.

17. A computer program product for providing echo compensation of at least one audio microphone signal that includes an echo signal contribution due to an audio loudspeaker signal in a loudspeaker-microphone system, the computer program product comprising a non-transitory computer-readable medium having computer readable program code stored thereon, the computer readable program configured to:

convert overlapped sequences of the audio loudspeaker signal from a time domain to a frequency domain and obtain a time series of short-time loudspeaker spectra with a predetermined number of sub-bands, wherein the sequences have a predetermined sequence length and an amount of overlapping of the overlapped sequences predetermined by a loudspeaker sub-sampling rate;

temporally interpolate the time series of short-time loudspeaker spectra, including, for each pair of temporally adjacent short-time loudspeaker spectra, calculate an interpolated short-time loudspeaker spectrum by weighted addition of the temporally adjacent short-time loudspeaker spectra;

compute an estimated echo spectrum with its sub-band components for at least one current loudspeaker spectrum by weighted addition of a current short-time loudspeaker spectrum and previous short-time loudspeaker spectra, up to a predetermined maximum time delay, wherein:

first filter coefficients are used for weighting the current loudspeaker spectrum and the corresponding previous short-time loudspeaker spectra with increasing time delay;

second filter coefficients are used for weighting the interpolated short-time loudspeaker spectra temporally adjacent to the current loudspeaker spectrum and the corresponding previous short-time loudspeaker spectra; and the first and second filter coefficients are estimated by an adaptive algorithm;

convert overlapped sequences of the audio microphone signal from the time domain to the frequency domain and obtain a time series of short-time microphone spectra with a predetermined number of sub-bands, wherein the sequences have a predetermined sequence length and an amount of overlapping of the overlapped sequences predetermined by a microphone sub-sampling rate;

adaptively filter the time series of short-time microphone spectra of the microphone signal by at least subtracting a corresponding estimated echo spectrum from a corresponding microphone spectrum, wherein the first and second filter coefficients are applied and sub-band components of the spectra are used for the subtraction;

convert the filtered time series of short-time spectra of the microphone signal to overlapped sequences of a filtered audio microphone signal; and overlap the sequences of the filtered audio microphone signal to generate an echo compensated audio microphone signal.

* * * * *